US006233741B1

(12) United States Patent
Loree, IV et al.

(10) Patent No.: US 6,233,741 B1
(45) Date of Patent: May 22, 2001

(54) NECKTIES WITH ATTACHING OUTWARDLY CONCEALED EYEGLASS WIPING DEVICE AND METHODS FOR MAKING SAME

(76) Inventors: Leonor Fresnel Loree, IV, 332 Gulfview Rd., Atlanta, GA (US) 30309; Richard Earnest Thompson, II, 2051 Fairhaven Cir., Atlanta, GA (US) 30305

( * ) Notice: Subject to any disclaimer, the term of this patent is extended or adjusted under 35 U.S.C. 154(b) by 0 days.

(21) Appl. No.: 09/511,331

(22) Filed: Feb. 23, 2000

Related U.S. Application Data

(63) Continuation-in-part of application No. 09/309,324, filed on May 11, 1999.

(51) Int. Cl.[7] ..... A41D 25/16
(52) U.S. Cl. ..... 2/157
(58) Field of Search ..... 2/157, 144, 145, 2/146, 147, 148, 149, 150, 152.1, 153, 155, 156

(56) References Cited

U.S. PATENT DOCUMENTS

| | | | | |
|---|---|---|---|---|
| 1,772,575 | | 8/1930 | Costanzo . | |
| 1,916,507 | * | 7/1933 | Green et al. | 2/144 |
| 2,234,312 | * | 3/1941 | Miller | 2/146 |
| 3,842,436 | * | 10/1974 | Hirschson | 2/157 |
| 3,950,790 | * | 4/1976 | Adler | 2/144 |
| 4,506,389 | * | 3/1985 | Franklin | 2/144 |
| 4,525,411 | | 6/1985 | Schmidt . | |
| 5,142,703 | | 9/1992 | Basinger et al. . | |
| 5,201,076 | * | 4/1993 | Schemine, Jr. | 2/145 |
| 5,285,312 | * | 2/1994 | Mastro | 359/516 |
| 5,435,011 | | 7/1995 | Nicolai et al. . | |
| 5,463,779 | | 11/1995 | Pinkus . | |
| 5,745,918 | * | 5/1998 | Shukla et al. | 2/144 |
| 5,870,776 | * | 2/1999 | Blackman | 2/144 |
| 5,963,987 | * | 10/1999 | Walls | 2/144 |

* cited by examiner

*Primary Examiner*—John J. Calvert
*Assistant Examiner*—Alissa L. Hoey

(57) ABSTRACT

A necktie with an attaching outwardly concealed eyeglass wiping device and method for making the same are disclosed. The method for making the necktie of the present invention includes providing an outer shell having a decorative side, a back side opposite the decorative side, a large end, a small end opposite the large end, and two sides extending substantially from the large end to the small end. The method further includes placing an lining on the back side of the outer shell for providing shape and body to the necktie, the lining having a large end, a small end, and a lengthwise portion connecting the large end to the small end, wherein the large end is disposed substantially adjacent the large end of the outer shell, and wherein at least one end of the lining includes at least one friction layer. According to the method, two sides of the outer shell are folded towards the back side of the outer shell to create an envelope, and the lengthwise portion of the lining is disposed substantially within the envelope. Additionally, tipping material is fixed to the rear side of the necktie. According to the method of the present invention, the at least one friction layer facilitates the movement of the tipping material in conjunction with movement of the outer shell such that when the tipping material is placed against glass and the outer shell is moved, the tipping material will move relative to the glass.

3 Claims, 4 Drawing Sheets

NECKTIES WITH ATTACHING OUTWARDLY CONCEALED EYEGLASS WIPING DEVICE AND METHODS FOR MAKING SAME

CROSS-REFERENCE TO RELATED APPLICATIONS

This application is a continuation-in-part of co-pending application, Ser. No. 09/309,324, entitled "Necktie With Attaching Outwardly Concealed Eyeglass Wiping Device", filed on May 11, 1999, and incorporated herein by reference.

FIELD OF THE INVENTION

The present invention relates to neckties and their method of construction, and more specifically, to neckties having a lining with a friction surface that facilitates the use of a concealed end of the necktie for use as a portable glass lens wiper, and methods of constructing the same.

BACKGROUND OF THE INVENTION

Since the invention of eyeglasses, eyeglass wearers have been faced with the problem of oily and greasy smears and smudges that often times result from handling the lenses, and since the advent of the silk necktie as standard business attire, eyeglass-wearing professionals have found themselves using their own neckwear as an impromptu device for attempting to remove such smudges. Left uncleaned, the smears and smudges on one's eyeglasses can blur one's vision through the lenses, and can also create an unkempt and unprofessional appearance for the professional. Unfortunately for the myopic professional, neither the silk outer-shell nor the acetate or polyester taffeta tipping material currently used in the manufacture of ties offer effective cleaning results. Instead, these materials merely smear the oily smudges even further around the area of the lenses.

Since the recent introduction of high-density, super-fine fibrous cleaning cloth, optometrists have begun recommending the use of pieces of such special cleaning cloths as the best way to clean eyeglass lenses, due to the fact that such cloths provide a quick, effective and scratch-free means of cleaning lenses. However, even though such pieces of cloth are available to consumers, eyeglass wearers often forget to carry them with them. Co-pending application, Ser. No. 09/309,324, entitled "Necktie With Attaching Outwardly Concealed Eyeglass Wiping Device", filed May 11, 1999, describes a necktie having tipping material constructed out of a special microfiber cleaning cloth, such that a wearer of the tie can use the tipping of the necktie to clean eyeglasses. Such a necktie is constructed in substantially the same manner as conventional neckties, but for the use of a specialized microfiber cleaning cloth as the tipping material, instead of the standard silk acetate or polyester used for the tipping in conventional neckties.

Although the microfiber cleaning cloth necktie tipping described in the copending application is effective in cleaning glass, such as eyeglass lenses, when such a necktie is constructed using conventional tie manufacturing methods, the effectiveness of such cleaning can be somewhat inhibited. This is because when pressure is applied to the outer shell of the tie, typically silk, in an attempt to move the underlying microfiber cleaning cloth tipping material with respect to a glass lens, the outer shell or silk can move or slip, without causing corresponding movement of the microfiber cleaning cloth material with respect to the lens. These results occur because the outer shell, interlining, and microfiber cleaning cloth of the necktie are not attached to each other and because the outer shell is typically made of material which moves easily with respect to the lining of the necktie. Therefore, while the microfiber cleaning cloth necktie tipping described in the co-pending application may be effective as a cleaning device, the construction of such necktie in a conventional manner may limit the effectiveness of its use due to the slipping of the respective layers of the tie with respect to each other.

Therefore, what is needed is a tie and a method of constructing the same, where movement of the outer shell of the tie facilitates a corresponding movement of the microfiber cleaning cloth, or tipping material, such that the tie can be effectively used as a cleaning device.

SUMMARY OF THE INVENTION

According to one embodiment of the invention, a method for making a necktie capable of cleaning glass is provided, wherein the necktie has a front side and a rear side, and wherein the front side is visible when the necktie is being worn. The method includes providing an outer shell having a decorative side, a back side opposite the decorative side, a large end, a small end opposite the large end, and two sides extending substantially from the large end to the small end. The method further includes placing an lining on the back side of the outer shell for providing shape and body to the necktie, the lining having a large end, a small end, and a lengthwise portion connecting the large end to the small end, wherein the large end is disposed substantially adjacent the large end of the outer shell, and wherein at least one end of the lining comprises at least one friction layer. The method further includes fixing of tipping material to the rear side of the necktie. According to the method, two sides of the outer shell are folded towards the back side of the outer shell to create an envelope, and the lengthwise portion of the lining is disposed substantially within the envelope. According to the method of the present invention, the at least one friction layer facilitates the movement of such tipping material in conjunction with movement of the outer shell such that when the tipping material is placed against glass and the outer shell is moved, the tipping material will move relative to the glass.

According to one aspect of the invention, a layer of glue is added to at least one side of the at least one end of the lining to form the at least one friction layer. Alternatively, a layer of glue may be added to both sides of the at least one end of the lining to form friction layers on both sides of the lining, such that the outer shell, tipping material, and lining engage each other at the at least one end of the lining. According to one method of the present invention, the back side of the outer shell may be adhered to the layer of glue, such that the outer shell moves in conjunction with the lining. Likewise, the back side of the outer shell may be adhered to the layer of glue by heating the necktie, such that the layer of glue bonds to the back side of the outer shell. In addition to adhering the outer shell to the lining, the tipping may be adhered to the lining through the layer of glue, such that the tipping material moves in conjunction with the lining.

According to another embodiment of the present invention, a method for constructing a necktie comprising a lining and exterior layers comprising an outer shell and tipping material is disclosed. According to this embodiment, the tipping material is capable of efficiently cleaning glass, and the lining of the necktie has at least one friction layer such that the lining and at least one exterior layer of the tie will move concurrently, facilitating the movement of tipping material against the glass. The method includes providing an elongated lining having a large end and a small end, wherein the lining gives body and form to the necktie, placing a layer of glue on at least one side of the lining and on at least the large end and the small end of the lining, and incorporating the lining into the necktie such that the layer of glue is located between the lining and at least one of the exterior layers of the tie, so that the outer shell and tipping material will move in concert.

According to one aspect of the invention, placing a layer of glue on the lining includes placing a layer of glue on both sides of the lining and on at least the large end and the small end of the lining. Alternatively, placing a layer of glue on the lining can comprise placing the layer of glue on one side of the lining and on at least the large end and the small end of the lining. According to the method of the invention, incorporating the lining into the necktie can comprise incorporating the lining into the necktie such that the layer of glue is located between the lining and the outer shell of the tie. Additionally or alternatively, incorporating the lining into the necktie can also comprise incorporating the lining into the necktie such that the layer of glue is located between the lining and the tipping material.

According to yet another embodiment of the invention, a necktie capable of efficiently cleaning glass is provided. The necktie has a front side and a rear side, where the front side is visible when the necktie is being worn. The necktie includes an outer shell having a decorative side, a back side opposite the decorative side, a large end, a small end opposite the large end, and two sides extending substantially from the large end to the small end, wherein the two sides are folded towards the back side of the outer shell to create an envelope. The necktie further includes a lining for providing shape and body to the necktie, the lining having a large end, a small end, and a lengthwise portion connecting the large end to the small end, wherein the large end is disposed substantially adjacent the large end of the outer shell, wherein the lengthwise portion is disposed within the envelope, and wherein at least one end of the lining comprises at least one friction layer. Additionally, the necktie includes a microfiber cloth for cleaning glass, wherein the microfiber cloth is fixed to the rear side of the necktie. The microfiber cloth for cleaning glass can be a super-fine synthetic fibrous cloth for cleaning glass, and may be concealed when the necktie is worn.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1A:
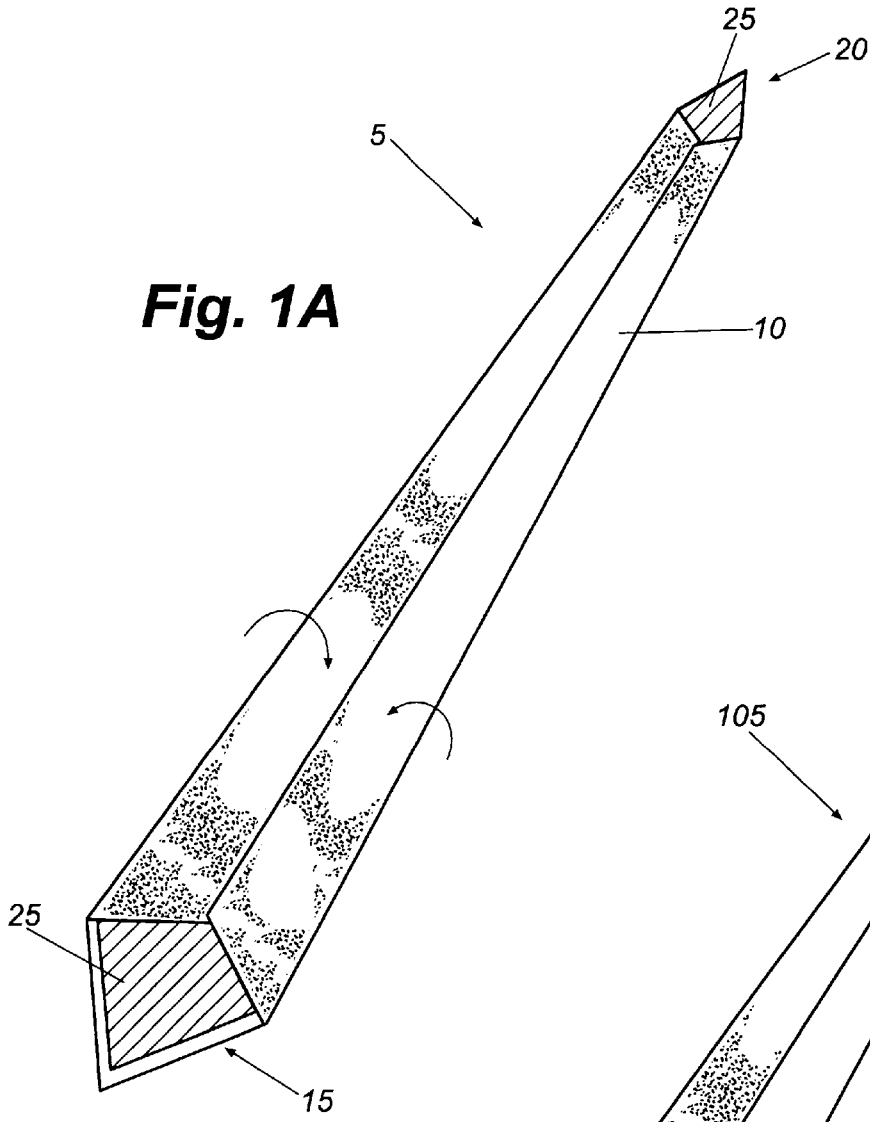
FIG. 1A shows the back side of the outer shell of a conventional necktie, including a large end, a small end, and tipping material located at both the large end and small end.

FIG. 1A shows the rear side of a conventional necktie 5, including an outer shell 10, a large end 15, a small end 20, and tipping material 25 located at both the large end 15 and small ends 20. Typically, the outer shell 10 is cut from and comprised of a patterned fabric sheet (typically silk) in the preferred shape, such that both the large end 15 and small end 20 are tapered, forming a V shape at each end of the necktie 5. The outer shell 10 of the necktie 5 can be comprised of one long cut piece of fabric, or of two or more pieces sewn end to end to form the lengthy shape of the necktie 5. The outer shell typically includes a decorative side, a back side opposite the decorative side, and two sides extending substantially from the large end 15 to the small end 20. As shown in FIG. 1, at both the large and small ends 15, 20 of the necktie 5 is tipping material 25 which is stitched to the outer shell 10 of the tie to give the ends of the tie a finished look. As explained in detail in co-pending application, Ser. No. 09/309,324, entitled "necktie With Attaching Outwardly Concealed Eyeglass Wiping Device" (hereinafter referred to as "the co-pending patent application"), incorporated herein by reference, the tipping material 25 may be stitched in the form of a V at the large end and small end of the decorative side of the outer shell 10, and thereafter turned inside out so that the stitching between the tipping material 25 and outer shell 10 does not show, as in FIG. 1A.

Figure 1B:
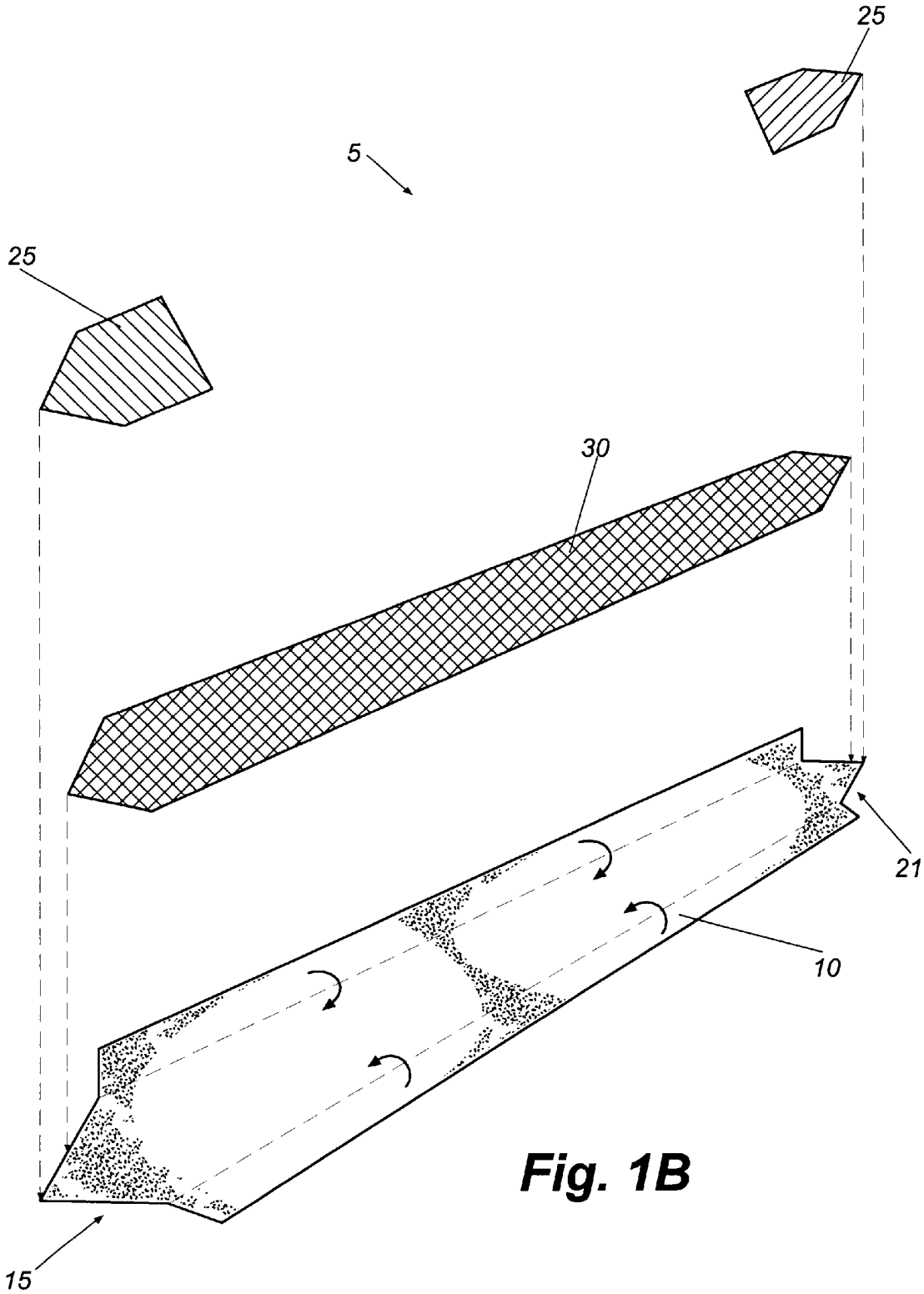
FIG. 1B shows the layers of the conventional necktie illustrated in FIG. 1A, including a lining material.

FIG. 1B shows the layers of the conventional necktie 5 illustrated in FIG. 1A, including a lining material 30. The lining material 30 abuts the back side of the outer shell 10, and has a large end, a small end, and a lengthwise portion connecting the large end to the small end. The purpose of the lining material 30 is to provide the body and shape of the necktie 5. As illustrated in FIG. 1B, the lining material 30 is disposed substantially adjacent the outer shell 10, and includes V-shaped ends corresponding to the large and small V-shaped ends of the outer shell 10 so that the lining material 30 is generally cut in the shape of the finished necktie 5. As will be appreciated with reference to FIG. 1B, the lining material 30 is located at the center of, and substantially disposed within, the envelope created by folding the two sides of the outer shell 10 towards the back side of the necktie 5, which is indicated by arrows in FIG 1A and FIG. 1B. In most conventional neckties, the lining material 30 is constructed of wool, polyester, or a man-made synthetic material, which gives the necktie 5 body and resiliency. This is required due to the fact that the outer shell 10 is often made of very flexible material, such as silk, which does not maintain shape and is typically very thin.

Also shown in FIG. 1B is the tipping material 25 of the necktie 5. When the tie is complete, as in FIG. 1A, the tipping material 25 is visible only at the ends of the necktie 5, and as such, does not need to run the entire length of the necktie 5. Rather, the tipping material 25 may be located solely at the V-shaped ends of the necktie 5. This reduces the cost of manufacturing the necktie 5, and helps keep the necktie 5 thin, which may be important when tying the necktie 5. As will be appreciated by those of skill in the art, the purpose of the tipping material 25 is to cover the lining material 30 of the necktie 5 at the ends of the necktie 5, because the outer shell 10 fails to cover the lining material 30 in its entirety after the necktie 5 is constructed. Therefore, the tipping 25 serves a decorative function to hide the lining material 30 from view, in case the necktie 5 were to turn over during use. Additional functions of the tipping 25 are to providing added structural integrity to the necktie 5 by enclosing the lining 30 into the necktie 5 without the need for stitching between the outer shell 10 and the lining material 30, which would be undesirable to the fashion-conscious wearer.

As disclosed in the co-pending patent application, if the tipping material is comprised of a material that is sufficient for cleaning glass lenses, then such tipping material may also be utilized as a wiping device for eyeglasses. According to the co-pending patent application, the tipping material may be constructed of a microfiber material, so that a wearer of the tie can utilize the tipping material located on backside of the tie as a cleaning device, particularly, for cleaning eyeglasses. The construction of a tie with microfiber tipping material is described in the co-pending patent application, and can be a process identical to that of the construction of conventional ties.

Nevertheless, when a necktie with a tipping material usable as a glass cleaning device is constructed in the manner of a conventional necktie, the effectiveness of using the tipping material to clean glass by pressing and rubbing it against such glass can be somewhat inhibited. When the tie is constructed using conventional methods, and utilized as a cleaning device, the outer shell, tipping and lining material often slide across one another. Consequently, where the tipping material at the end of a tie is placed against a piece of glass, such as an eyeglass lens, and the outer shell on the decorative side of the tie is moved, the tipping material may not move with respect to the glass. Rather, the outer shell may simply move relative to the lining and tipping material. If this occurs, it results in the ineffectiveness of the tipping material as a cleaning device, due to the fact that the tipping may fail to move with respect to the item to be cleaned.

Figure 2A:
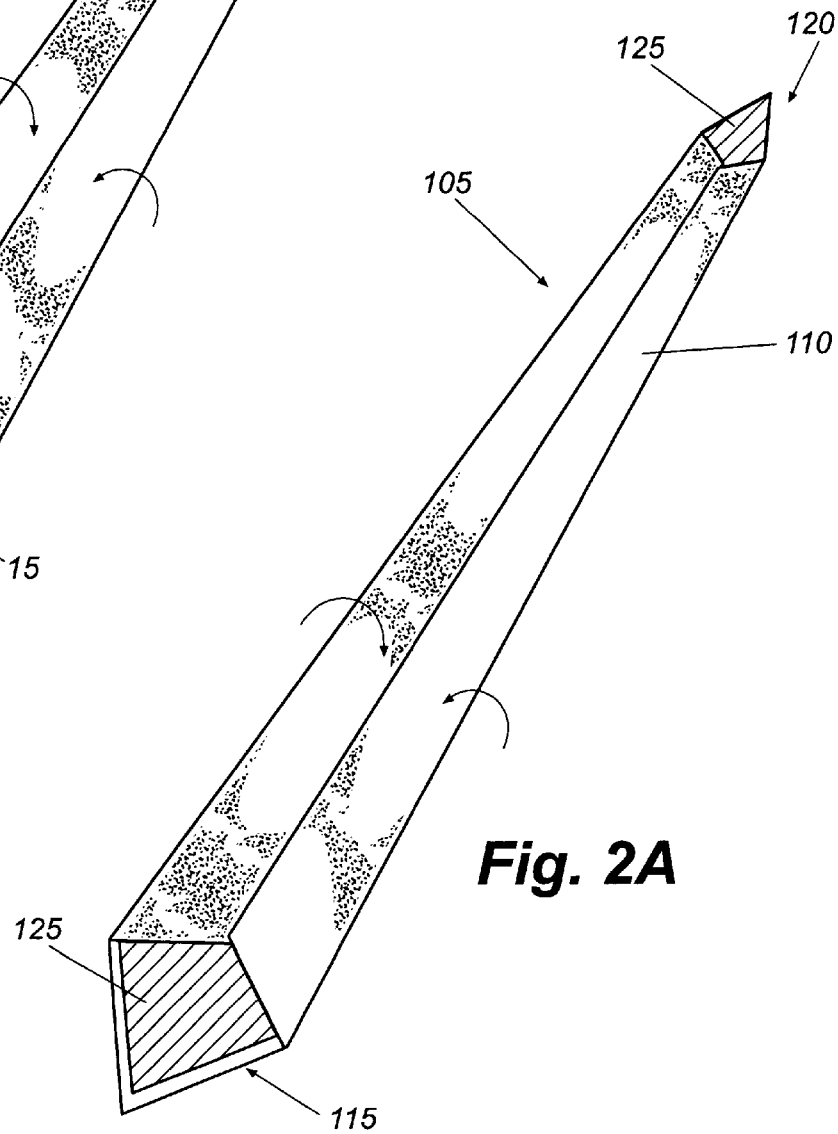
FIG. 2A shows the back side of an outer shell of the necktie of the present invention, according to one aspect of the invention.
Figure 2B:
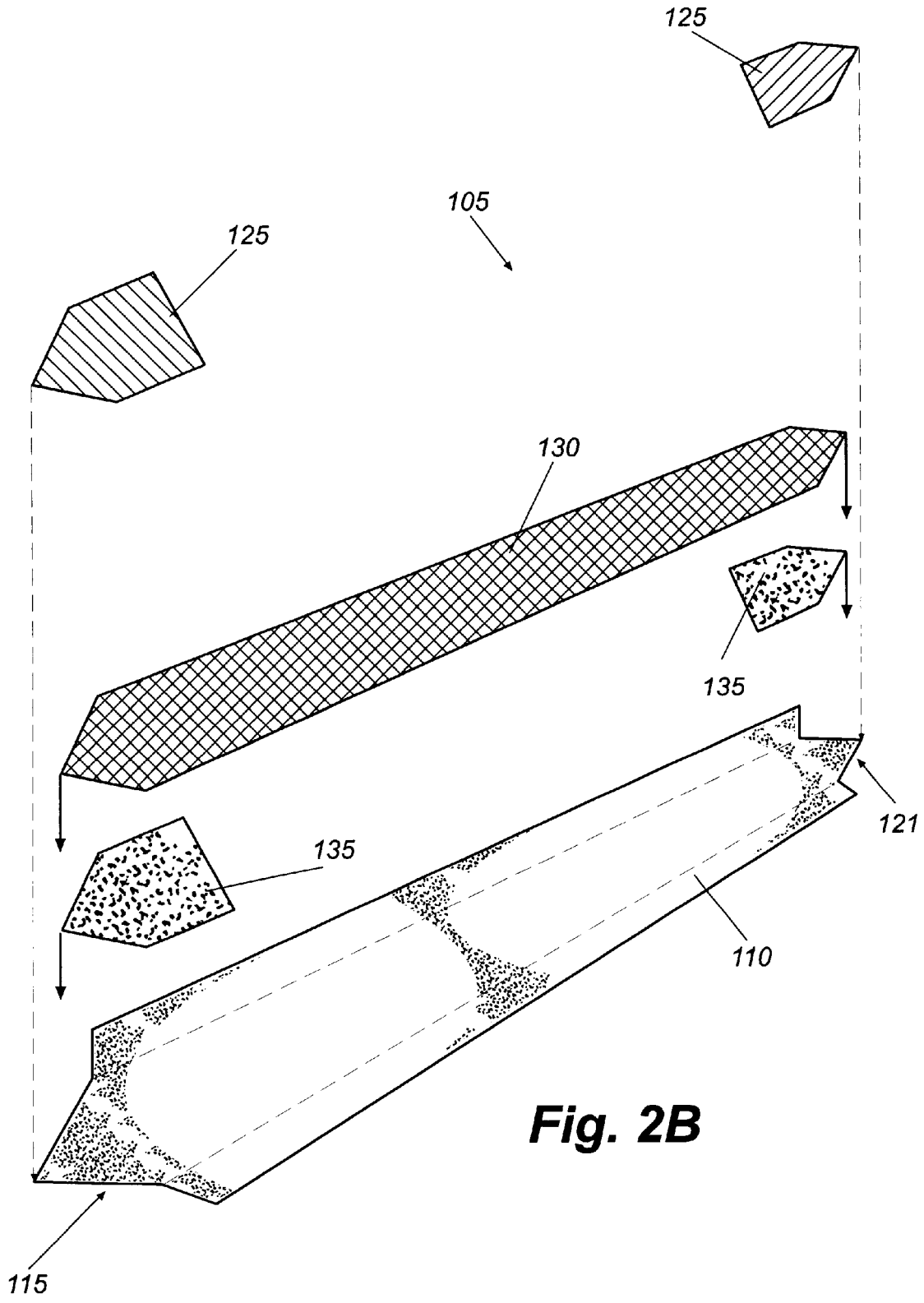
FIG. 2B shows the layers of a necktie of the present invention, including a lining having at least one friction surface, according to one aspect of the present invention.

FIG. 2A shows the rear side of a necktie 105 of the present invention, according to one aspect of the invention. As will be appreciated with reference to FIG. 1A, the necktie 105 of the present invention appears identical to conventional neckties 5. Like the conventional neckties 5, the visible portions of the necktie include the outer shell 110, and tipping material 125. However, as will be appreciated with reference to FIG. 2B, discussed below, the necktie 105 is constructed to overcome the deficiencies of conventional methods of constructing neckties so that the tipping material 125 may more effectively be used as a cleaning device. FIG. 2B shows the layers of the necktie shown in FIG. 2A, and including a lining material 130 having at least one friction layer 135, according to one aspect of the present invention.

Figure 4:
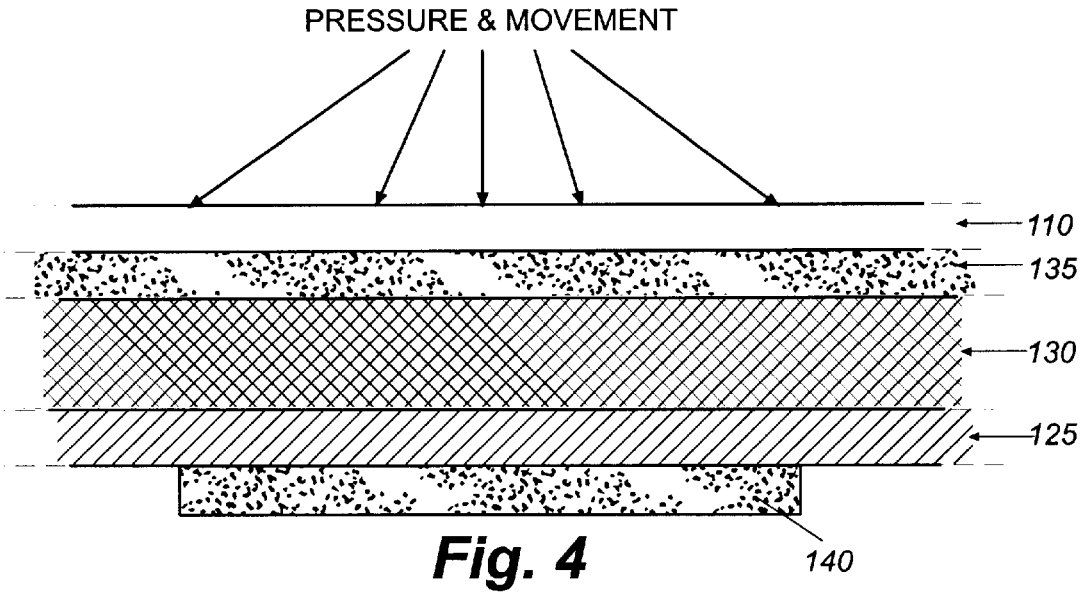
FIG. 4 shows a cross-sectional view of one end of a necktie of the present invention as the necktie is used as a wiping device, according to one aspect of the present invention.

As illustrated in FIG. 2B, the lining material 130 of the necktie includes at least one friction layer 135, so that the tipping material 125 will be less likely to slip with respect to the movement of the outer shell 110. As will be appreciated by those of skill in the art, the tie of the present invention is constructed similar to conventional ties, but for the introduction of an additional friction layer 135. As illustrated in FIG. 2B, the friction layer 135 is disposed between the lining material 130 and the outer shell 110 to facilitate the movement of the tipping material in conjunction with movement of the outer material. Therefore, for example, when the tipping material 125 is placed against an item to be cleaned, such as glass, and the outer shell 110 is moved, the tipping material 125 will move in conjunction with the outer shell 110 relative to the glass. This is illustrated in FIG. 4 and is discussed in detail below.

According to one aspect of the invention, the friction layer 135 can be a web-based adhesive, such as a polyamide based web, that effectively bonds the lining and the outer shell without damaging either material. For example, the adhesive may be a dry adhesive that can be applied directly between the lining material 130 and the outer shell 110 so that the flexibility, feel and look of the tie 105 are not negatively affected. One example of such an adhesive is PA1001, an adhesive produced by Spunfab, which is web based and nonsticky to the touch before heat is applied. However, virtually any adhesive may be used which effectively bonds the lining material 130 to the outer shell 110 without damage to either materials. It should be appreciated, however, that after application, the adhesive should remain relatively lightweight, flexible and thin. For example, adhesives which may be used in the construction of the necktie 105 may include wet, dry, web-based, powder-based, or spray-on adhesives.

Although FIG. 2B shows the friction layer 135 as located between the lining material 130 and the outer shell 110, the friction layer can additionally or alternatively be placed between the lining material 130 and the tipping material 125. Adding the friction layer 135 on both sides of the lining 130 can help to effectively bond all layers of the necktie 105 together, which may be advantageous where slipping occurs between the tipping material 125 and outer shell 110 of the necktie 105 when the tipping material is used as a cleaning device. However, it should be appreciated that such an implementation also increases the thickness and stiffness of the necktie 105, which may be aesthetically undesirable. The friction layer 135 could also be solely introduced between the lining material 130 and the tipping material 125. However, introducing the friction layer 135 between the lining material 130 and the outer shell 110 is likely more effective, as direct pressure will often be applied to an outer shell comprising silk, which exhibits a high tendency to move relative to the lining material 130. Therefore, if the friction layer 135 is placed solely between the lining material 130 and the tipping material 125, the tipping material may be less effective as a cleaning device because the outer shell may slide with respect to the lining material 130 so that the tipping material 125 does not move in conjunction with the outer material 110.

As will be appreciated by those of skill in the art, the friction layer 135 may be accomplished in a manner other than introducing an adhesive or adhesive layer. For instance, the friction layer 135 could comprise an additional layer of material that has a surface characteristics which grab adjacent layers to provide the friction necessary to prevent the outer shell 110 or other materials in the necktie 105 from slipping. Additionally, the friction layer 135 could also represent a surface of the lining material 130, which has been chosen so that the outer shell 110 and tipping material 125 will not slip when only one is moved. For instance, although commonly used lining materials, such as wool, polyester, and man-made synthetics do not provide enough friction between the adjacent layers of the necktie 105 to prevent the tipping material 125 from slipping with respect to movement of the outer shell 110, the lining materials may be treated so that sufficient surface roughness is generated. For example, the lining material 130 may experience an acid or stone wash, or may be abraded such that the surface of the lining material 130 is roughened.

Figure 3:
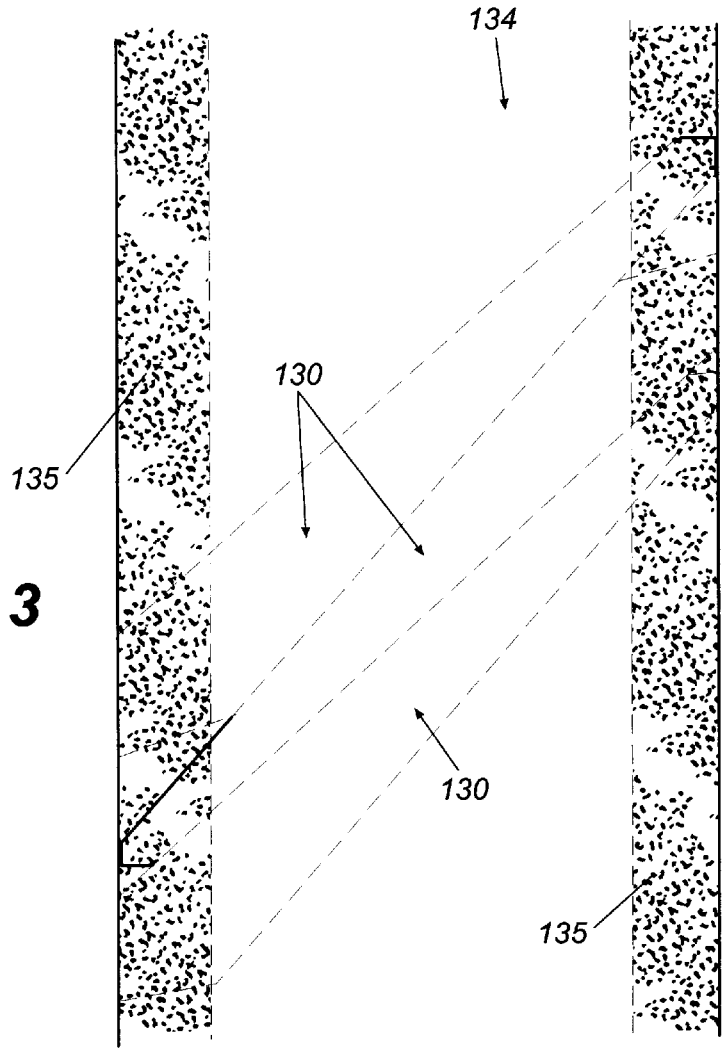
FIG. 3 shows a method in which a friction layer is added to a surface of the lining material, according to one aspect of the present invention.

FIG. 3 shows a method in which a friction layer 135 is added to a surface of the lining material, according to one aspect of the present invention. More specifically, FIG. 3 shows a sheet of lining 134, which may be cut to produce multiple linings for the construction of finished neckties. The individual lining materials 130 that may be cut from the sheet of lining are illustrated with dotted lines in FIG. 3. The sheet of lining material 134 may be in the form of pre-cut rolls, having a set length and width, and each lining material 130 may be oriented on the sheet of lining at a 45 degree angle. As stated above, like the large and small ends 115, 120 of the necktie, the lining material 130 is constructed with a tapered V-shaped ends which are typically cut into the material during construction of the necktie. Although the lining material 130 is illustrated as being cut from one sheet, which results in inexpensive and efficient construction of a large number of lining material 130, it will be appreciated that the lining material 130 may also be individually cut, or cut in another manner other than that shown in FIG. 3, as will be appreciated by those of skill in the art.

Although, as previously stated, the friction layer 135 can be added to one or more sides of the lining material 130, FIG. 3 shows the friction layer 135 as being placed only on one side of the necktie 105. According to one aspect of the invention, the friction layer 135 comprises a web-based adhesive, which may be generated by an adhesive manufacturer and available in a roll form, having a pre-set width and length. When such an adhesive is used to construct a necktie according to the present invention, the adhesive can be rolled on each end of the lining, as shown in FIG. 3. Two pre-cut rolls of adhesive are preferably utilized, each roll of adhesive having generally the same length as the sheet of lining 134, which may also be in roll form. However, the adhesive is preferably only a fraction of the width of the lining material 130, because the adhesive need only be located in the same portion of the necktie where the tipping material 125 is situated. For example, according to one aspect of the invention, the sheet of lining may be 38 inches wide by 60 yards in length, and the adhesive glue may be 4.5 inches in width by 60 yards long.

The application of the friction layer 135 may require the application of heat so that the friction layer 135 is bonded or fixed to the lining material 130. For instance, where a dry, web-based adhesive is rolled onto the ends of the lining material 130, the material may be required to be subsequently heated to sear the adhesive to the lining. Alternatively, the heat may be applied concurrently with the application of the adhesive. After heating, the lining material/adhesive combination may be cooled, which can bring the glue back to a non-sticky state. According to one aspect of the invention, in which the PA1001 web-based adhesive is utilized, after application of the adhesive, lining material/adhesive combination may be exposed to 90 degree Fahrenheit heat on both the top and bottom of the lining material/adhesive combination. It should be appreciated that an adhesive should be chosen such that heating the adhesive to achieve bonding does not damage the lining. The combination is subsequently cooled before the combination is incorporated into the necktie during manufacture.

Alternatively, the application of the friction layer 135 may not involve heat, such as where a sticky adhesive is sprayed onto the sheet of lining 134. However, this may prove to be troublesome during further construction of the necktie, due to the fact that the lining material 130 would have to be handled after a sticky adhesive has already been applied. It should be appreciated by those of skill in the art that the alternative methods for creating a friction layer 135 may also be implemented where the lining material 130 is produced from a sheet of lining 134. For example, the sheet of lining 134 could be fed through a roller or similar device which roughens the ends of the lining material 130. Similarly, any suitable substance for producing the friction layer 135 may be added to the lining material 130 to roughen its ends, via any combination of heat, pressure, rollers, spray devices, and similar apparatus.

After the friction layer 135 is generated, the necktie 105 may be manufactured as a conventional necktie. Conventional tie manufacturing processes include the finishing step of heating the tie to give the tie a crisp and pressed look. This heating should not negatively affect the friction layer 135, where the friction layer does not require heat to cause the lining material 130 to bond or connect with an adjacent layer of the necktie, such as the tipping material 125, outer shell 110, or both. However, where one or more friction layers comprise an adhesive which has been bonded to the lining material 130 and subsequently cooled, the final heating step should re-activate the adhesive so that a bond forms between the lining material 130 and one or more adjacent layers of the necktie. Thereafter, the finished necktie 105 is cooled, so that the adhesive is brought back to a non-sticky state. Therefore, it should be appreciated that the heating temperature and/or adhesive material should be chosen such that the re-activation of the adhesive can occur, without damage to the materials of the necktie. It should be appreciated that this heating step should be the last stage in the manufacturing process, because once heat is re-introduced, the bond between the lining and outside shell occur.

FIG. 4 shows a cross-sectional view of one end of a necktie of the present invention as the necktie is used as a wiping device, according to one aspect of the present invention. The figure includes one end of the necktie 105, including the tipping material 125, the lining material 130, the friction layer 135, and the outer shell 110. Also illustrated in FIG. 4 is a piece of glass 140, which is representative of an eyeglass lens, which may be cleaned by a necktie 105 according to the present invention. Although the friction layer 135 is only included between the lining material 130 and outer shell 110, it should be appreciated that a friction layer 135 may additionally or alternatively be added between the lining material 130 and tipping material 125.

As can be appreciated with reference to FIG. 4, pressure will be applied to the outer shell 110, such that the outer shell will be moved in a number of directions in an attempt to clean the piece of glass 140. In conventional neckties, where the friction layer 135 does not exist, this pressure and movement may cause the outer shell to slip or slide with respect to the lining material, the tipping material, or both, such that the tipping material will not move in conjunction with the movement of the outer shell. The present invention overcomes this problem through the introduction of one or more friction layers 135. As illustrated in FIG. 4, a friction layer 135 is introduced between the outer shell 110 and the lining material 130. The friction layer 135 may be bonded directly to the adjacent layers, or may include sufficient coarseness such that movement of the outer shell 110 will result in movement of the friction layer 135, and corresponding movement of the lining material 130 and tipping material 125, such that the necktie can be efficiently used as a cleaning device. As stated above, in conventional ties, during the movement of the outer shell 110, slipping occurs most at the point between the outer shell 110 and lining material 130. Therefore, by incorporating the friction layer into the necktie, the present invention overcomes the disadvantages of prior methods of manufacturing neckties for use as a cleaning device.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A necktie capable of efficiently cleaning glass, wherein the necktie has a front side and a rear side, and wherein the front side is visible when the necktie is being worn, comprising:

an outer shell having a decorative side, a back side opposite the decorative side, a large end, a small end opposite the large end, and two sides extending substantially from the large end to the small end, wherein the two sides are folded towards the back side of the outer shell to create an envelope;

an lining for providing shape and body to the necktie, the lining having a large end, a small end, and a lengthwise portion connecting the large end to the small end, wherein the large end is disposed substantially adjacent the large end of the outer shell, wherein the lengthwise portion is disposed within the envelope, and wherein at least one end of the lining comprises at least one friction layer, and a microfiber cloth for cleaning glass, wherein the microfiber cloth is fixed to the rear side of the necktie.

2. The necktie of claim 1, wherein the microfiber cloth for cleaning glass is a super-fine synthetic fibrous cloth for cleaning glass.

3. The necktie of claim 1, wherein the microfiber cloth for cleaning glass is concealed when the necktie is worn.

* * * * *